US006446605B1

(12) United States Patent
Fehrmann et al.

(10) Patent No.: US 6,446,605 B1
(45) Date of Patent: Sep. 10, 2002

(54) METHOD AND DEVICE FOR CONTROLLING AN INTERNAL COMBUSTION ENGINE

(75) Inventors: Ruediger Fehrmann, Leonberg; Andreas Kellner, Moeglingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/689,390

(22) Filed: Oct. 12, 2000

(30) Foreign Application Priority Data

Oct. 12, 1999 (DE) ..... 199 48 971

(51) Int. Cl.[7] ..... F02M 41/00
(52) U.S. Cl. ..... 123/456; 123/458
(58) Field of Search ..... 123/456, 447, 123/457, 458, 497, 506, 514

(56) References Cited

U.S. PATENT DOCUMENTS 5,241,933 A * 9/1993 Morikawa ..... 123/198 D
5,445,129 A * 8/1995 Barnes ..... 123/446
5,531,111 A * 7/1996 Okamoto et al. ..... 73/149
5,609,136 A * 3/1997 Tuken ..... 123/357
6,311,669 B1 * 11/2001 Przymusinski et al. ..... 123/300

FOREIGN PATENT DOCUMENTS

| | | | |
|---|---|---|---|
| DE | 195 48 278 | | 6/1997 |
| DE | 197 35 561 | | 2/1999 |
| GB | 2328295 | * | 2/1999 |

* cited by examiner

*Primary Examiner*—Tony M. Argenbright
*Assistant Examiner*—Mahmoud Gimie
(74) *Attorney, Agent, or Firm*—Kenyon & Kenyon

(57) ABSTRACT

A method and a device for controlling an internal combustion engine, in particular an internal combustion engine having a common rail system. A pump delivers fuel into an accumulator. A sensor signal, which characterizes the fuel pressure prevailing in the accumulator, is detected. On the basis of a filtered sensor signal, a correction value is able to be preset for correcting the sensor signal.

7 Claims, 2 Drawing Sheets

METHOD AND DEVICE FOR CONTROLLING AN INTERNAL COMBUSTION ENGINE

BACKGROUND INFORMATION

A method and a device for controlling an internal combustion engine are described in German Patent No. 195 48 278. It describes a method and a device for regulating the pressure in an accumulator of a common rail system (CR system). It is customary in such CR systems to stipulate the time period that the injectors are driven as a function of the fuel quantity to be injected and of the pressure prevailing in the accumulator. The pressure in the accumulator is measured in synchronism with rotational speed. The pressure is regulated within a fixed time grid by sampling the rail pressure, just been measured in synchronism with the speed, in synchronism with time as well.

Furthermore, it is known from German Patent No. 197 35 561 to sample the pressure values in fixed time intervals. In the control of injected fuel quantities, accurate quantity values are derived only when the fuel pressure is known during injection. Imprecise pressure measurements can lead to a quantity error and, thus, to degraded emissions performance of the internal combustion engine.

SUMMARY OF THE INVENTION

Given a method and a device for controlling an internal combustion engine, an underlying object of the present invention is to reduce the quantity errors and thereby improve the emissions characteristics of the internal combustion engine.

DETAILED DESCRIPTION

Figure 1:
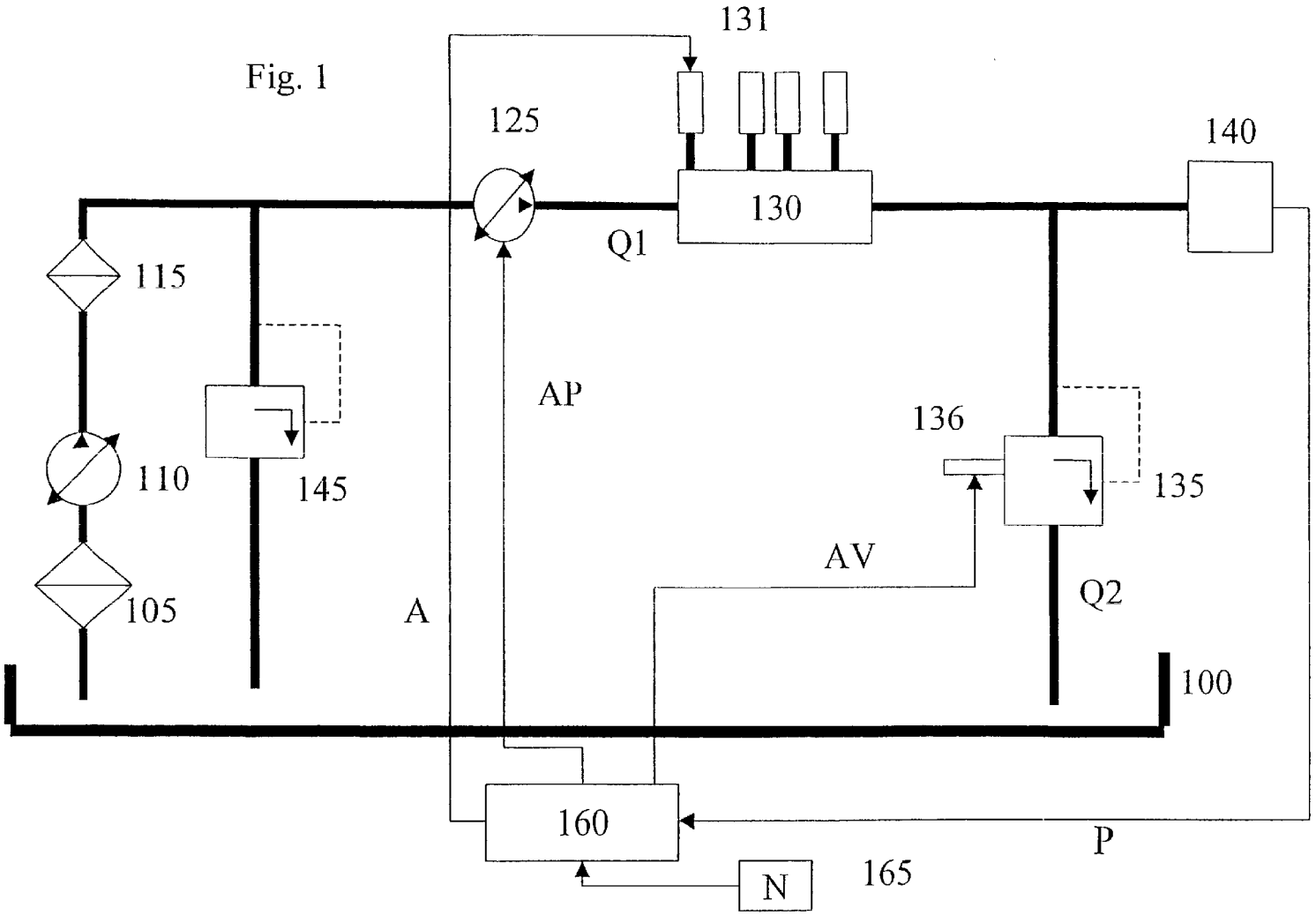
FIG. 1 depicts a block diagram of the device according to the present invention.

FIG. 1 depicts those components of a fuel-supply system for an internal combustion engine having high-pressure injection which are important for an understanding of the present invention. The system shown is usually referred to as a common rail system.

A fuel reservoir (tank) is denoted by 100. It is connected via a first filter 105 and an auxiliary supply pump 110 to a second filter means 115. From second filter means 115, the fuel is conveyed via a line to a high-pressure pump 125. The passage means between filter means 115 and high-pressure pump 125 is connected via a low-pressure relief valve 145 to reservoir 100. High-pressure pump 125 communicates with a rail 130. Rail 130 is also designated as an accumulator, and is in contact via fuel-supply lines with various injectors 131. Via a pressure-discharge valve 135, rail 130 is able to be connected to fuel reservoir 100. Pressure-discharge valve 135 is able to be controlled by a solenoid 136.

The lines between the outlet of high-pressure pump 125 and the inlet of pressure-discharge valve 135 are designated as the high-pressure region. In this region, the fuel is under high pressure. The pressure prevailing in the high-pressure region is detected by a sensor 140. The lines between reservoir 100 and the inlet of high-pressure pump 125 are designated as the low-pressure region.

A control 160 applies a drive signal AP to high-pressure pump 125, a drive signal A to injectors 131, and/or a drive signal AV to pressure-discharge valve 135. Control 160 processes various signals from various sensors 165, which characterize the operating state of the internal combustion engine and/or of the motor vehicle being driven by the internal combustion engine. Such an operating state is, for example, the speed N of the internal combustion engine.

This device functions as follows: the fuel in the tank is delivered by auxiliary supply pump 110 through filter means 105 and 115.

In response to the pressure in the low-pressure region rising to unacceptably high values, low-pressure relief valve 145 opens and releases the connection between the outlet of auxiliary supply pump 110 and reservoir 100.

High-pressure pump 125 delivers fuel quantity Ql from the low-pressure region into the high-pressure region. High-pressure pump 125 builds up a very high pressure in rail 130. In systems used for internal combustion engines having externally supplied ignition, one usually attains pressure values of, for instance, 30 to 100 bar, and for self-ignition engines, of for instance, 1000 to 2000 bar. The fuel can be metered under high pressure via injectors 131 to the individual cylinders of the internal combustion engine.

Sensor 140 is used to detect pressure P prevailing in the rail, i.e., in the entire high-pressure region. The pressure in the high-pressure region is regulated by controllable high-pressure pump 125 and/or by pressure-discharge valve 135.

If, as high-pressure pumps, one uses pumps mechanically driven by the camshaft or the crankshaft of the internal combustion engine, then harmonic compressive oscillations (compressional vibrations) can occur, for example with camshaft frequency or with integral fractions thereof. To compensate for the effect of these compressive oscillations, the present invention provides for the output signal from the pressure sensor to be filtered and, on the basis of this filtered signal, to generate a correction value for correcting the sensor signal. The thus corrected sensor signal is used for further control of the internal combustion engine. In particular, using the corrected sensor signal as a baseline, a drive input signal for the injectors is generated using a characteristics map, drawing upon the injected fuel quantity. The time period for energizing (driving) the injectors is read out of the characteristics map.

As a filter, a band-pass filter is preferably used, whose mid-frequency corresponds to the camshaft frequency or to an integral fraction thereof.

Figure 2:
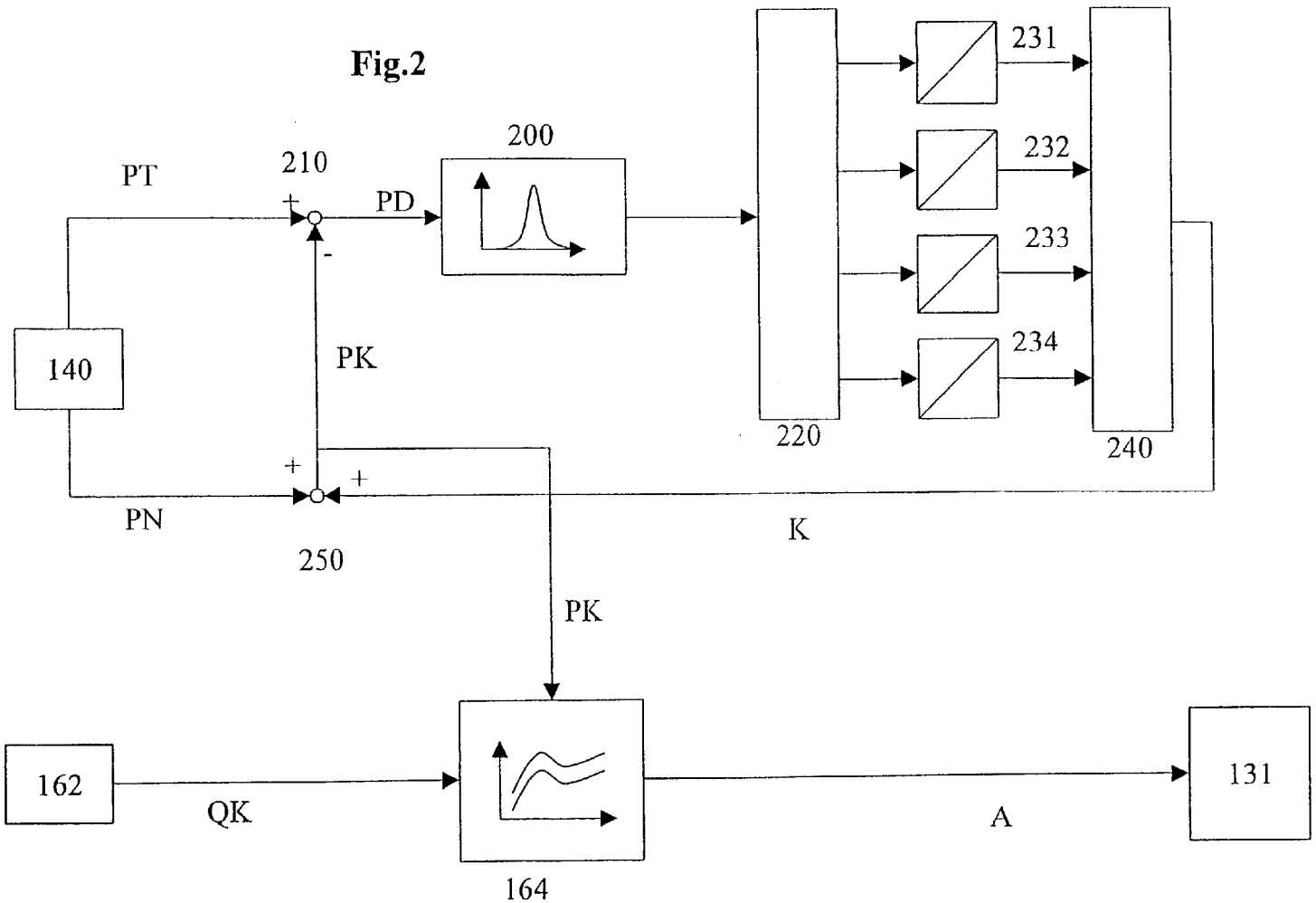
FIG. 2 shows a detailed block diagram of the device according to the present invention.

A device of this kind is shown in FIG. 2 as a block diagram.

A first output signal PT from sensor 140 is received with a positive operational sign at a first interconnection node 210. Output signal PD from interconnection node 210 arrives at a filter 200, which, in turn, applies a signal to a first cylinder counter 220. From cylinder counter 220, the signal arrives optionally at one of controllers 231, 232, 233 and 234. Controllers 231 through 234 are preferably designed as integral controllers. In particular, the number of controllers corresponds to the number of cylinders of the internal combustion engine, one controller being assigned to each cylinder of the internal combustion engine. The illustrated exemplary embodiment is of a four-cylinder internal combustion engine. However, the present invention can be easily applied to internal combustion engines having a different number of cylinders. A corresponding number of controllers would then be provided.

From controllers 231 through 234, the signal is transmitted via a second cylinder counter 240, to arrive with a positive operational sign at a second interconnection node

250. Second output signal PN from sensor 140 is applied with a positive operational sign at the second input of interconnection node 250. Output signal PK from second interconnection node 250 arrives, on the one hand, at a characteristics map 164 and, on the other hand, with a negative operational sign at the second input of first interconnection node 210. In addition, a signal QK from a fuel-quantity setpoint selection 162 is fed to characteristics map 164. Injectors 131 receive a drive signal A from characteristics map 164.

Sensor 140 supplies a signal indicative of the pressure prevailing in the high-pressure region. This signal arrives as a first signal PT in fixed time intervals at an interconnection node 210. In addition, the output signal from the sensor arrives as a second signal PN in fixed angular distances (spacings) at second interconnection node 250. This second signal, which is read out in fixed angular distances, is preferably used for calculating duration A for driving the injectors.

Second sensor signal PN is detected at a specific camshaft or crankshaft angle. As a rule, the signal is detected at the same angular position of the camshaft or crankshaft. First signal PT is detected in substantially smaller distances (arcs of rotation). This signal is preferably reproduced in constant time intervals, the signal being output several times per metering operation; it is preferably output in a 1 ms grid (signaling pattern).

The two signals PT and PN are compared in interconnection node 210, second signal PN being able to be corrected using a correction value K. This thus generated difference PD between the two signals is filtered by filter 200. Filter 200 is preferably a bandpass having a mid-frequency, which corresponds to the frequency with which the compressive oscillations occur. This means that the mid-frequency corresponds to the camshaft frequency or to integral fractions thereof.

The thus filtered signal arrives via cylinder counter 220 at one of controllers 231 through 234. Provision is made in this context for one controller to be allocated to each cylinder. The output signal from the controller, which sums up filtered difference PD, is received at the second interconnection node as correction value K, where it is superposed cumulatively on second sensor signal PN. The thus corrected sensor signal arrives, on the one hand, at the characteristics map, where it is used to further control the internal combustion engine, in particular to define the driving duration (energizing time period). In addition, the thus corrected signal is compared in interconnection node 210 to the first signal.

What this signifies is that correction values K for the individual cylinders are formed in such a way that the harmonic compressive oscillations are compensated; i.e., the difference between the signal detected synchronously with respect to the angle and that detected synchronously with respect to time, becomes zero. As a result, the compressive oscillations do not have an effect on the values of signal PN. This means that the compressive oscillations have no influence on the driving duration, and, consequently, do not affect the injected fuel quantity.

What is claimed is:

1. A method for controlling an internal combustion engine having a common rail system, comprising the steps of:

delivering fuel from at least one pump into an accumulator;

detecting a sensor signal which characterizes a fuel pressure prevailing in the accumulator;

filtering the sensor signal; and presetting, as a function of the filtered sensor signal, a correction value for correcting the sensor signal.

2. The method according to claim 1, wherein the corrected sensor signal is used to further control the engine.

3. The method according to claim 1, wherein the corrected sensor signal is used to determine a quantity indicative of a fuel quantity to be injected.

4. A device for controlling an internal combustion engine having a common rail system, at least one pump delivering fuel into an accumulator, the device comprising:

means for detecting a sensor signal indicative of a fuel pressure prevailing in the accumulator;

a filter for filtering the sensor signal; and means for predefining, as a function of the filtered sensor signal, a correction value for correcting the sensor signal.

5. A method for controlling an internal combustion engine having a common rail system, comprising the steps of:

delivering fuel from at least one pump into an accumulator;

detecting a sensor signal which characterizes a fuel pressure prevailing in the accumulator;

detecting a first sensor signal in fixed time intervals;

detecting a second sensor signal in fixed angular distances;

filtering the sensor signal; and presetting, as a function of the filtered sensor signal, a correction value for correcting the sensor signal.

6. The method according to claim 5, further comprising the steps of:

filtering the first sensor signal; and correcting the second sensor signal.

7. A method for controlling an internal combustion engine having a common rail system, comprising the steps of:

delivering fuel from at least one pump into an accumulator;

detecting a sensor signal which characterizes a fuel pressure prevailing in the accumulator;

filtering the sensor signal; and presetting, as a function of the filtered sensor signal, a correction value for correcting the sensor signal;

wherein the sensor signal is filtered by at least one bandpass filter, having a mid-frequency corresponding to at least an integral fraction of a camshaft frequency.

* * * * *